United States Patent [19]

Kampschreur

[11] Patent Number: 4,541,709

[45] Date of Patent: Sep. 17, 1985

[54] IMAGE TRANSFER APPARATUS

[75] Inventor: Rutgerus J. M. Kampschreur, Venlo, Netherlands

[73] Assignee: Océ-Nederland B.V., Venlo, Netherlands

[21] Appl. No.: 573,621

[22] Filed: Jan. 25, 1984

[30] Foreign Application Priority Data

Feb. 4, 1983 [NL] Netherlands ..... 8300415

[51] Int. Cl.[4] ..... G03G 15/00

[52] U.S. Cl. ..... 355/3 TR; 355/3 BE; 355/14 TR; 430/126

[58] Field of Search ..... 355/3 TR, 14 TR, 3 R, 355/3 BE, 16, 77; 430/126; 270/52; 226/37

[56] References Cited

U.S. PATENT DOCUMENTS

| | | | |
|---|---|---|---|
| 3,991,992 | 11/1976 | Randall et al. | 270/52 |
| 4,068,937 | 1/1978 | Willemse et al. | 355/3 TR |
| 4,341,455 | 7/1982 | Fedder | 355/3 TR |
| 4,371,251 | 2/1983 | Morse | 355/3 TR |
| 4,435,067 | 3/1984 | Draai et al. | 355/3 TR |
| 4,453,820 | 6/1984 | Suzuki | 355/3 TR |
| 4,455,079 | 6/1984 | Miwa et al. | 355/3 TR |

FOREIGN PATENT DOCUMENTS 2003428 3/1979 United Kingdom .

*Primary Examiner*—A. C. Prescott

*Attorney, Agent, or Firm*—Albert C. Johnston

[57] ABSTRACT

In an image transfer apparatus comprising two separate image carrying media, such as endless belts, from one of which image information can be transferred to the other medium by temporarily holding the two media in frictional contact with one another, each of the media is advanced at constant or substantially constant speed by its own drive system; the drive system of a first medium comprises a feedback control system which controls the speed of that medium so that a measuring signal which is delivered by a measuring circuit and represents the measured speed of the first medium is equal to a reference signal delivered by a reference source; and during each transfer interval, when the two media are being advanced at the same speed under the frictional force of their contact with one another, the feedback control of the speed of the first medium is interrupted and an adjusting signal is produced by which the relationship of the measuring and reference signals is adjusted so that the speed of the first medium will be substantially the same as that of the second medium when the two media are being advanced separate from one another.

8 Claims, 5 Drawing Figures

IMAGE TRANSFER APPARATUS

This invention relates to an apparatus for transferring image information, of a type which comprises first and second media for carrying image information, respective drive systems for advancing the media each at a constant or substantially constant speed and means for pressing one medium into frictional contact with the other medium for a specific interval of time so that while the media are in contact with one another image information may be transferred from one medium to the other with the media being held to the same speed under the influence of the frictional contact.

An image transfer apparatus of the type mentioned in which the moving media are in the form of webs, or belts, is disclosed in U.S. Pat. No. 3,991,992. In that apparatus, use is made of a control combination including means for generating a reference signal; a feedback control system comprising a measuring circuit for generating a measuring signal representing the speed of the first medium and control means for controlling the speed of the drive of the first medium so that the measuring signal will be equal to the reference signal; a displaceable pressure element for bringing one medium into frictional contact with the other medium, and decoupling means which interrupt the feedback control of the drive of the first medium during the time interval of the media being held in contact with one another.

That known apparatus is disadvantageous in that the speeds of the two belts are not equal when the belts are brought into contact with one another, and as a result a slip will exist between the belts during a short time of their frictional contact which is required to make their speeds become equal. This slip produces objectionable wear of the media. Also, because of the speed changes, the media will not run uniformly and this has an adverse effect on image quality.

The problem of speed differences cannot be eliminated in the manufacture of such an apparatus by making the drive systems of the media so that the two speeds are equal, because the parameters of the drive systems so diverge in the course of time and usage that the speeds of the media will again differ from one another. Also, the speeds may differ after components of the apparatus have been replaced, because of differences which occur between parameters of the old and parameters of the new components. In either case needs will exist for the speeds of the drive systems to be readapted to one another by a skilled technician or engineer.

The principal object of the present invention is to provide an image transfer apparatus of the type mentioned by which the disadvantages noted above can be overcome.

In accordance with this invention, in an image transfer apparatus of the type mentioned, a speed control system is provided which includes means for adapting the drive systems of the two media one to the other during one or more of the time intervals when the media are being advanced at the same speed by frictional contact with one another so that the respective drive systems thereafter will keep the speeds of the media equal when the media are being advanced separate from one another. As a result, slip between the media is avoided when the media are again brought into frictional contact for a time interval of transfer. Further, the speed adaptations can be effected so frequently that practically no difference of the media speeds will result from divergencies of parameters of the drive systems. Hence, no need exists for time-consuming speed adjustments by a skilled technician or engineer, and the transfer apparatus operates with less media wear and better image quality.

The speed control system of an apparatus according to the invention includes a reference means for generating a reference signal at a value representing a required speed of the two image carrying media; a feedback control in the drive system of the first medium, including measuring circuit means for generating a measuring signal at a value which is a measure of the speed of the first medium and speed control means operative while the media are being advanced separate from one another for controlling the speed of the first medium to a value governed by relative values of the measuring and reference signals; means rendering that speed control means inactive during each interval of the media being advanced in frictional contact with one another; means operable within one or more of the intervals of the media being advanced in contact with one another to produce and retain an adjusting signal representing the relation of the speed of the media to the reference signal; and means operable thereafter when the media are being advanced separate from one another to produce an adjusted measuring signal representing the relation of the measuring signal to the adjusting signal, so that the controlled speed of the first medium when it is being advanced separate from the second medium will be substantially the same as its speed when it is being advanced in frictional contact with the second medium for transferring image information from one medium to the other.

Thus, according to a principal feature of the invention, the feedback control in the drive system of the first image carrying medium is provided with adjusting means which are operable within a time interval of the two media being advanced at the same speed by frictional contact with one another to produce an adjusting signal whereby, when the media are advanced separate from one another, the relation of the measuring signal to the reference signal is adjusted so as to keep the measuring and reference signals substantially equal to one another.

The above mentioned and other objects, features and advantages of the invention will be further evident from the following description and the accompanying drawings of illustrative embodiments of the invention. In the drawings.

Figure 1:
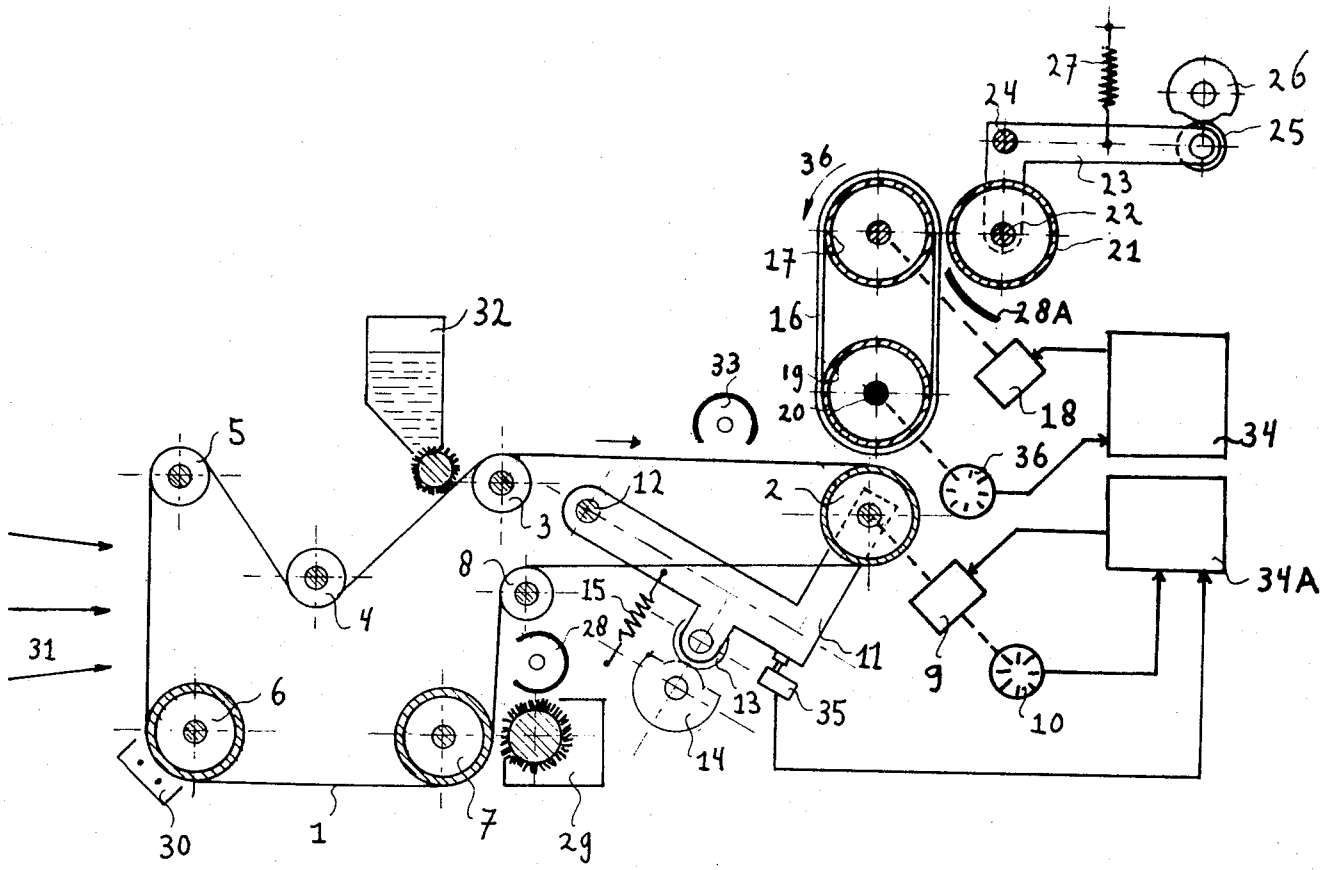
FIG. 1 is a schematic sectional view of a copying machine in which the transfer apparatus of the invention may be used.

In the copying machine as illustrated in FIG. 1, an endless photoconductive belt 1 is trained over a pressure roller 2 and over guide rollers 3, 4, 5, 6, 7 and 8 which are mounted so as to be freely rotatable. Pressure roller 2 is driven by means of a D.C. servomotor 9.

Pressure roller 2 is mounted in two arms 11 which are pivotable about the axis of a shaft 12, one of these arms being disposed behind the other and therefore not visible in FIG. 1.

The arms 11 are each provided with a cam follower 13 which cooperates with a rotatably mounted cam 14. A tension spring 15 acting on the arms 11 keeps cam follower 13 constantly in contact with cam 14. A detector 35 is disposed beneath one of the arms 11 at a location such that the detector 35 is activated when the arm is in its lowest position. An image carrying medium in the form of an endless belt 16 trained over a drive roller 17 and a rotatably mounted roller 19 is disposed above the pressure roller 2. Belt 16 is provided with a thin top layer made of soft silicone rubber. A heating element 20 is disposed inside the roller 19 to heat the surface thereof. Near the drive roller 17 a freely rotatable roller 21 is mounted on a shaft 22 connected to two arms 23 disposed one behind the other, so as to form a rigid unit pivotally mounted on a shaft 24. FIG. 1 shows only one of the arms 23. The arms 23 are provided with a cam follower 25 which cooperates with a rotatable cam 26, and a tension spring 27 acting on the arms 23 keeps the cam follower 25 constantly in contact with cam 26. Sheets of copy material can be fed by a conveyor means (not shown) along a conveying path 28A and introduced into the nip between the roller 21 and a portion of belt 16 supported on roller 17.

The belt 16 is driven in the direction of arrow 36 by a D.C. servomotor 18 which is coupled with the shaft of the drive roller 17. The servomotor 18 forms part of a feedback control system which further comprises a pulse disc 36 and a motor controller 34. Pulse disc 36 is coupled with the shaft of roller 19. Motor controller 34 controls the terminal voltage of the motor 18 in response to pulses generated by the disc 36, in such manner that the speed of the belt 16 as measured by the pulse disc 36 remains constant.

The photoconductive belt 1 is driven in the direction of an arrow by means of a feedback control system formed by the D.C. servomotor 9, a pulse disc 10 and a motor controller 34A. The D.C. servomotor 9 and the pulse disc 10 are both coupled with the shaft of pressure roller 2.

The motor controller 34A controls the terminal voltage of motor 9 in accordance with the number of revolutions of motor 9 measured by the pulse disc 10, in such manner that the measured speed of the belt 1 remains constant. Motor controller 34A includes a circuit connected with the detector 35, by which the operation of the feedback control system for controlling the speed of belt 1 is interrupted when the pressure roller 2 is displaced upward to press belt 1 against belt 16, the detector 35 then being activated. In that condition of the system the terminal voltage of the motor 9 is kept constant by the motor controller 34A.

Means of conventional type are disposed along the path of the belt 1 in order to form powder images electrophotographically on the photoconductive surface of belt 1. These means comprise a light source 28 for illuminating the belt 1 so as to remove any charges present on the belt 1; a cleaning brush 29 for removing any powder residues from the belt 1; a corona charging device 30 for applying a uniform electrostatic charge to the belt 1; a projection station 31 in which a light image produced by flash lamps (not shown) from an original supported on a platen (not shown) is projected onto a taut portion of belt 1 via an optical system (not shown) during which projection an imagewise charge pattern is formed on the belt 1; a magnetic brush developing device 32 for developing into a powder image the charge pattern formed on the belt 1 by the light image; and a light source 33 for illuminating the belt 1 to reduce the adherence between the powder image and the photoconductive belt surface. The copying machine is also provided with control means (not shown) to synchronize the operation of cams 14 and 26 with the operation of the image-forming means 28–33 referred to hereinabove.

When a powder image on belt 1 approaches the pressure roller 2 after being formed by successive charging, imagewise exposure and development steps, the cam 14 is rotated through 180° in response to a signal delivered by the control means of the copying machine. As a result, the arms 11 and the roller 2 are displaced upward and belt 1 is pressed against belt 16 between the rollers 2 and 19. Before the two belts contact one another detector 35 is deactivated by the displacement of arm 11. Consequently the feedback of the control system via the pulse disc 10 for controlling the speed of belt 1 is interrupted and the terminal voltage of motor 9 is kept constant.

When the belts 1 and 16 contact one another, belt 1 will assume the speed of belt 16 as a result of the frictional forces. The frictional forces thus eliminate any speed difference between the belts 1 and 16. If the speed difference between belts 1 and 16 is small before the belts touch one another, the frictional forces will remain small.

As the powder image passes the pressure zone between the belts on rollers 2 and 19, the powder image is pressed into the soft rubber layer of the belt 16, which takes up powder particles of the image so that the image is transferred from belt 1 onto belt 16. Although a very large part, typically 90–95%, of the image powder is transferred to the belt 16 during this transfer operation, it is inevitable that there will be a residue on the belt 1. This residue is later removed conventionally by the operation of lamp 28 and brush 29.

The transferred powder image while being taken up and carried on by belt 16 is heated by way of heating element 20, the sleeve of roller 19 and belt 16. The powder particles are softened and agglomerated by this heating so that the image has become tacky when it approaches the roller 21. In the meantime signals emitted by the copying machine control means have activated a conveying means (not shown) by which a sheet of copy material is fed via conveyor path 28A, and have caused the cam 26 to be rotated through an angle of 180° so that the arms 23 are pivoted about the axis of shaft 24 and roller 21 is pressed against the belt 16 on roller 17. When the image and the sheet of copy material then pass through the pressure zone between the roller 21 and the belt 16, the softened and tacky image material is pressed into the copy material. As a result, as the sheet passes through the pressure zone the entire image is separated from belt 16 and transferred onto the copy material. Upon cooling the image will be permanently bonded and thus fixed to the copy material.

After the image formed on the belt 1 has been thus transferred, the control means of the copying machine emits signals which cause the cams 14 and 26 and hence also rollers 2 and 21 to be returned to their original positions. When roller 2 again reaches the original position, the detector 35 is re-activated, whereupon the feedback in the control system is re-activated for controlling the speed of the belt 1.

Figure 2:
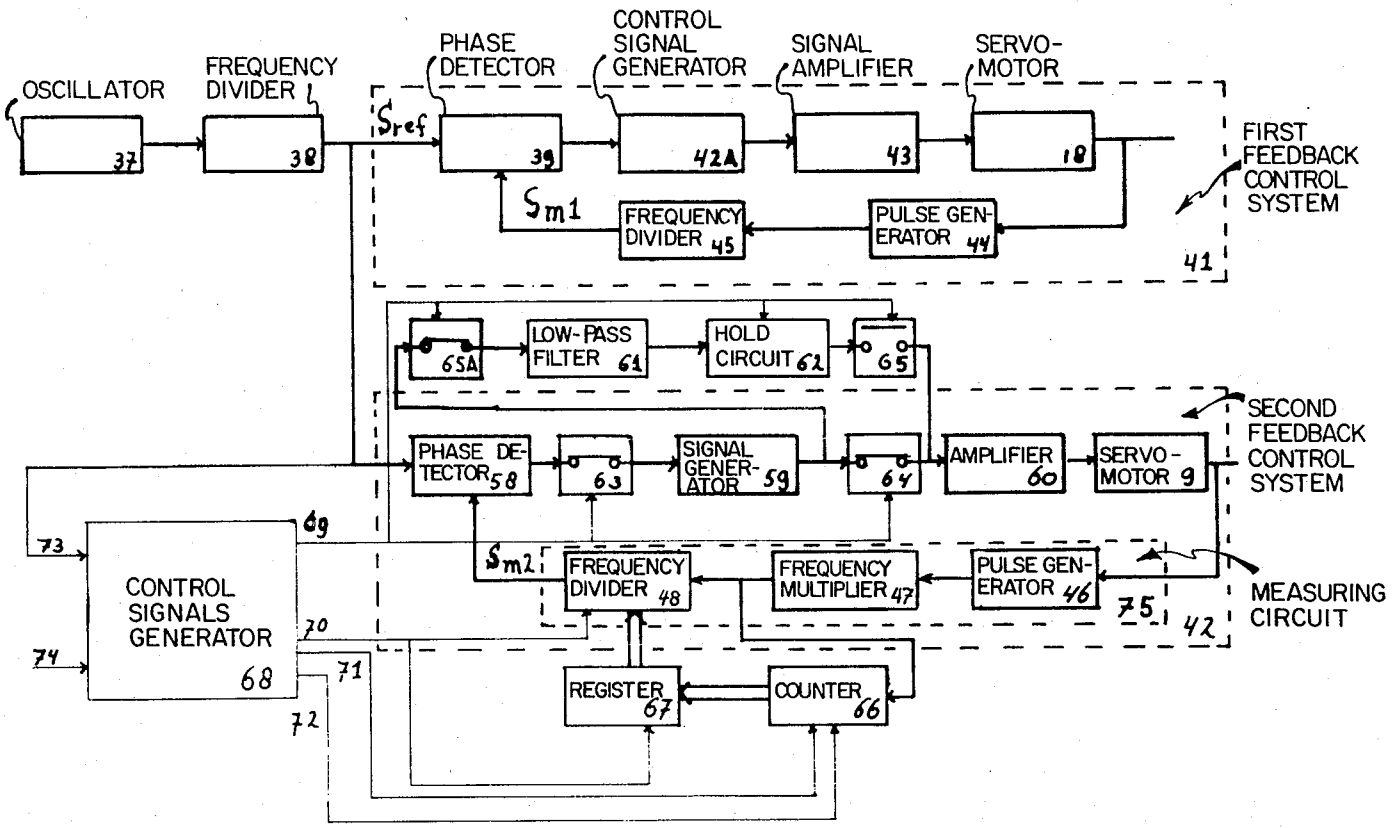
FIG. 2 is a schematic representation of a preferred embodiment of a control system of a transfer apparatus according to the invention.

In the block diagram of the feedback control systems as represented in FIG. 2, element 37 is a free-running oscillator the output signal of which is connected to a frequency divider 38. Oscillator 37 and frequency divider 38 together form a reference source generating a reference signal $S_{ref}$ at a frequency $f_{ref}$. The output signal of frequency divider 38 is fed to a first feedback control system 41 and a second feedback control system 42.

The first feedback control system 41 comprises the D.C. servomotor 18 by means of which belt 16 is driven via roller 17; a pulse generator 44 comprising the pulse disc 36, by means of which the speed of the belt 16 is measured and a pulse train is generated of a frequency proportional to the speed of the belt 16; a frequency divider 45 which delivers at a frequency $f_1$ the pulse train derived from the output signal of pulse generator 44, with its frequency reduced by a constant factor; a comparator in the form of a phase detector 39 which compares the phase of the reference signal $S_{ref}$ delivered by the frequency divider 38 with the phase of the measuring signal Sm1 delivered by the frequency divider 45, and generates a differential signal corresponding to the phase difference; a controller 42A which generates a control signal by reference to the differential signal; and an amplifier 43 by means of which the control signal is amplified and then delivered to the motor 18.

The second feedback control system 42 comprises the D.C. servomotor 9, by means of which belt 1 is driven via drive roller 2; a measuring circuit 75 which generates a signal at a frequency proportional to the speed of the belt 1; a comparator 58 in the form of a phase detector by means of which the phase difference is determined between the reference signal $S_{ref}$ delivered by the frequency divider 38 and the measuring signal Sm2 delivered by the measuring circuit 75, and which generates a differential signal proportional to the measured phase difference; a controller 59 which generates a control signal by reference to the differential signal; and an amplifier 60 which amplifies the control signal and delivers it to the motor 9.

The measuring circuit 75 comprises a pulse generator 46 which comprises the pulse disc 10 and delivers a signal at a frequency proportional to the speed of the belt 1; a frequency multiplier 47, to which is fed the pulse train generated by the pulse generator 46 and which derives therefrom a pulse train at a frequency which is a multiple of the frequency of the input signal; an adjustable divider 48 which derives from the pulse train delivered by multiplier 47 a pulse train whose frequency is an adjustable factor smaller than the frequency of the input signal.

The frequency divider 48, for example, is an integrated circuit marketed by RCA under the type number CD 40103. This integrated circuit comprises a counter which is loaded with a value according to the signals on the parallel inputs of the integrated circuit. The contents of the counter are reduced by 1 on each pulse fed to the input of the integrated circuit. When the counter contents are equal to 0 the integrated circuit generates a pulse-like output signal and the counter is re-loaded with the value according to the signals on the parallel inputs. The integrated circuit is also provided with a reset input, and the counter contents become equal to 0 if a pulse-like signal is delivered at the reset input. Consequently a pulse-like output signal is generated and the counter thereupon is re-loaded again.

The phase detector 58, for example, is part of an integrated circuit marketed by RCA under the type number CD 4046. The phase detector determines the extent to which the positive flanks of the delivered pulse-like input signals are offset relative to one another.

The output of controller 59 is connected to a hold circuit 62 via a low-pass filter 61. The output of the hold circuit 62 is connected via an electronic switch 65 to the input of amplifier 60. An electronic switch 63 is provided in the connection between the phase detector 58 and the controller 59. An electronic switch 64 is disposed in the connection between the controller 59 and the amplifier 60.

The pulse train at the output of frequency multiplier 47 is delivered also to the clock input of a counter 66. The parallel outputs of counter 66 are connected to the parallel inputs of a register 67. The outputs of register 67 are connected to the adjustable divider 48.

The output signal of frequency divider 38 and the output signal of detector 35 are connected to a control circuit 68. The control circuit 68 generates a plurality of control signals 69 to 72 inclusive by reference to the output signal 73 of frequency divider 38 and the output signal 74 of detector 35. Control signal 69 is connected to the control input of the hold circuit 62 and to the control inputs of the electronic switches 63, 64, 65 and 65A. The control signal 70 is connected to the reset input of divider 48 and to the load input of register 67. Control signal 71 is connected to the reset input of counter 66. Control signal 72 is connected to the count-enable input of counter 66. Control signals 69 to 72 inclusive are obtained by means of digital modules. In an alternative embodiment, a computer can be used to obtain the control signals.

Figure 3:
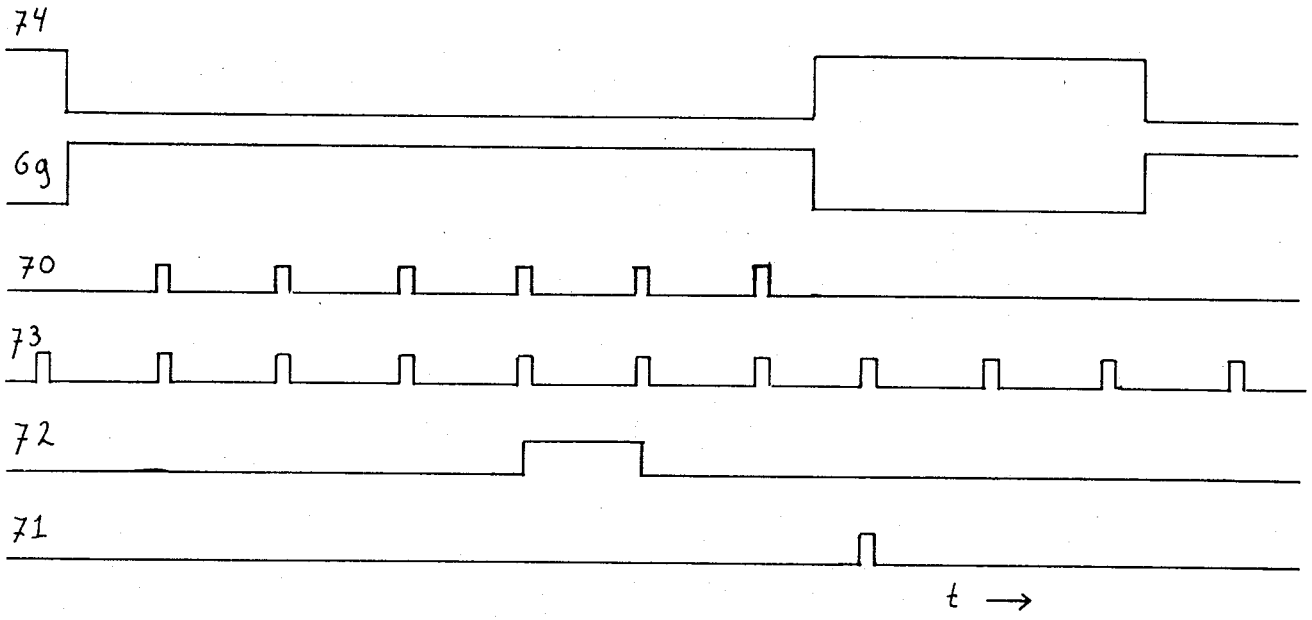
FIG. 3 is a time diagram of signals occuring in the operation of the control systems of FIG. 2.

In FIG. 3 the control signals 69 to 72 inclusive, the output signal 74 of the detector 35, and the output signal 73 of the frequency divider 38 are represented in relation to time. The output signal of the detector 35 is high when the detector 35 is activated and low when the detector 35 is de-activated. Control signal 69 is equal to the inverted output signal of detector 35. The pulse-like control signal 71, which is delayed to some extent, is generated as a result of the descending flank of the output signal 74 of detector 35. The control signal 70 is the result of a logic "AND" operation on control signal 69 and the output signal 73. During the time that the detector 35 is de-activated, control signal 72 becomes high for a period of the reference signal $S_{ref}$ originating from divider 38.

The control systems described with reference to the drawings operate as follows: A reference signal $S_{ref}$ is derived from oscillator 37 by means of frequency divider 38. This reference signal is delivered to feedback control system 41, by means of which the terminal voltage of motor 18 is controlled via controller 42A, according to a known manner of feedback control, so that the frequency $f_1$ of the output signal Sm1 of the frequency divider 45, which is a measure of the speed of the belt 16, becomes equal to the frequency of the reference signal $S_{ref}$, which is a measure of the required belt speed.

If no powder image is formed on belt 1, detector 35 remains activated. Switch 63 operated by control signal 69 then connects phase detector 58 to the controller 59 and switch 64, also operated by control signal 69, connects controller 59 to amplifier 60. The feedback is thus active in control system 42. The terminal voltage of motor 9 then is controlled, according to the known manner of feedback control, so that the frequency of the reference signal $S_{ref}$, which corresponds to the required belt speed, is equal to the frequency of the output signal Sm2 delivered by the adjustable divider 48, which output signal is a measure of the speed of the belt 1.

At the moment when a powder image is present on belt 1 to be transferred to belt 16, the arms 11 are lifted so that detector 35 is first de-activated and then the belts 1 and 16 are brought into contact with one another.

The de-activation of detector 35 causes control signal 69 to become high, and consequently the connection between the phase detector 58 and the controller 59 is interrupted by the switch 63 controlled by control signal 69, as well as the connection between controller 59 and amplifier 60 by switch 64. Switches 65 and 65A also are actuated by control signal 69 so that the input of amplifier 60 is connected to the output of the hold circuit 62 and the connection between the controller 59 and the low-pass filter 61 is broken. The hold circuit 62 thus is put in the hold state, and the output signal of hold circuit 62 then stays equal to the input signal of the hold circuit at the value which existed when the hold circuit 62 was brought into the hold state. The then existant value of the input signal of hold circuit 62 is equal to the average value of the output voltage of the controller 59 as determined by the low-pass filter 61. This average value is approximately equal to the value of the input voltage of the amplifier 60 required to drive the belt 1 at the required speed while the belts 1 and 16 are running out of contact with one another.

In an alternative embodiment, the average value of the current delivered to the motor 9 can be determined, and a current corresponding to this determined average value can be delivered to the motor 9 while the belts 1 and 16 are in contact with one another.

At the time when the belts 1 and 16 come into contact with one another, the belt 1 will acquire the speed of the belt 16 as a result of the frictional forces occurring between the two belts. The speed of belt 16 and hence also the speed of belt 1 are then kept constant by means of control system 41. Each of the motors 9 and 18 then delivers a portion of the torque required to drive the two belts at the required speed.

Figure 4:
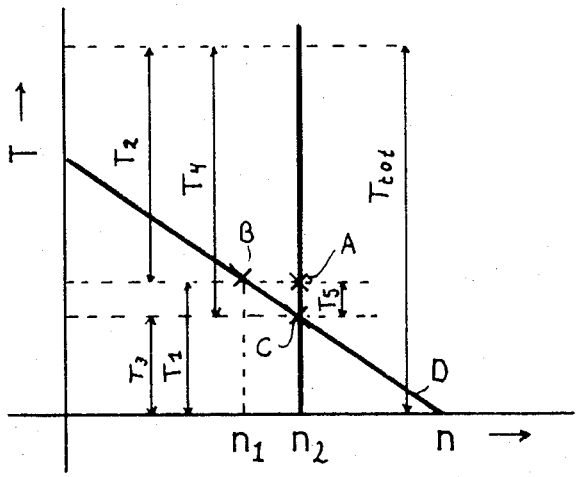
FIG. 4 is a chart representing the coupling speed curves and torque requirements of the two media.

The total torque required is divided up between the motors 9 and 18 in the manner illustrated by the chart of FIG. 4. Just before the two belts come into contact the feedback in control system 42 is interrupted and the constant terminal voltage from hold circuit 62 is fed via amplifier 60 to motor 9. The speed of belt 1 as a function of the delivered torque of motor 9 at this constant voltage is represented by line D in FIG. 4. The speed of belt 1 in the free-running state, i.e., when belt 1 is being driven out of contact with belt 16, will generally not be exactly the speed of belt 16. The speed $n_1$ of belt 1 and the associated torque $T_1$ of the motor 9 in the free-running state, as may be caused by a control voltage corresponding to the one to be fed from the hold circuit 62, are indicated by the point denoted by letter B. The torque required to drive belt 16 is equal to $T_2$, and the controlled speed of belt 16 is equal to $n_2$ (point A in FIG. 4).

When the belts 1 and 16 come into contact with one another the belt 1 will assume the speed $n_2$ of belt 16. The torque delivered by the motor 9 will thus become $T_3$ (point C in FIG. 4). The speed of belt 16 is kept equal to $n_2$ by means of control system 41. The torque delivered by motor 18 is equal to $T_4$ in these conditions. Value $T_4$ is equal to the total torque $T_{tot}$ required to drive both belts at the required speed, less the torque $T_3$ delivered by motor 9. The torque then required to drive the belt 1 originates from motor 9 as to one portion $T_3$ and from motor 18 as to the other portion $T_5$. The torque $T_5$ is transmitted by means of the frictional forces between the belt 1 and the belt 16.

It has been assumed in FIG. 4 that $n_1$ is smaller than $n_2$. If $n_1$ is greater than $n_2$, the torque required to drive the belt 16 originates largely from motor 9 and the remainder from motor 18. If the belt speeds $n_2$ and $n_1$ are close together, the torque $T_5$ is small and hence the frictional forces between belts 1 and 16 are also small.

When the powder image has been transferred to belt 16, the arms 11 are lowered again and detector 35 is re-activated. Consequently, control signal 69 is again made high by the control circuit 68. The feedback of control system 42 is thus restored through the electronic switches 63 and 64; the connection between the hold circuit 62 and amplifier 60 is interrupted again by electronic switch 65; hold circuit 62 is taken out of the hold state; and controller 59 is again connected to the low-pass filter 61 by electronic switch 65A.

During the interval when belts 1 and 16 are in contact with one another, control signal 70 becomes high simultaneously with output signal 73. Control signal 70 is delivered to the reset input of divider 48. Consequently, divider 48 generates an output pulse, the positive flank of which coincides substantially with the positive flank of the output signal 73. As a result, the phase difference determined by the phase detector 58 at the end of the interval during which the belts 1 and 16 are in contact with one another is small, so that the control system 42 is smoothly switched on by restoring the feedback.

The speed of belt 1 in the free-running state is so controlled that the frequency of the output signal Sm2 of the adjustable divider 48, which is a measure of the speed of belt 1, is equal to the frequency of the reference signal $S_{ref}$, which is a measure of the required speed. The speed of belt 16 is so controlled by means of control system 41 that the frequency of the output signal Sm1 of divider 45, which is a measure of the speed of belt 16, is equal to the frequency of the reference signal $S_{ref}$. The ratio between the speed of the belt 1 and the speed of the belt 16 can be adjusted by adjusting the divider 48.

The ratio between the belt speeds in the free-running state can be made to be 1 by adjusting the dividend of divider 48 so that the frequencies of the output signals of the dividers 45 and 48 are equal when the speeds of the belts 1 and 16 are equal. The dividend of divider 48 is determined by means of the counter 66 during the interval of time when the belts are in contact with one another. Within this interval of time the control signal 72 is caused to be high during a period of the signal 73 originating from the divider 38. As a result of the high signal 72, counter 66 is enabled to count the number of pulses delivered by the multiplier 47 during a certain interval of time. Apart from a small error due to the discrete character of the counting operation, the counted number of pulses represents the ratio between the frequency of the output signal 73 of the divider 38 and the frequency of the output signal of the frequency multiplier 47. Alternatively, if desired, the dividend can be determined over two or more of the periods of output signal 73.

After determination of the dividend, the contents of counter 66 remain constant until counter 66 is reset to 0 by control signal 71. This takes place a short time after detector 35 has been re-activated. Before the counter is set to 0 the contents of the counter are transferred to register 67. This is effected by means of control signal 70. Whenever the control signal 70 becomes high the contents of the counter 66 are loaded in register 67.

At the end of the interval in which the belts have been in contact with one another, counter 66 contains the determined dividend and thus this dividend is transferred to register 67. The contents of register 67 are fed to the adjustable divider 48. The frequency of the output signal of divider 48 is equal to the frequency of the output signal of the multiplier 47 divided by the dividend stored in register 67. Since this dividend is substantially equal to the ratio of the frequency of the output signal 73 of the divider 38 to the frequency of the output signal of the multiplier 47 at equal speeds of belts 1 and 16, the feedback control system 42 now functions to keep the ratio between the speeds of belts 1 and 16 substantially equal to 1 during the period while the belts are separated.

Figure 5:
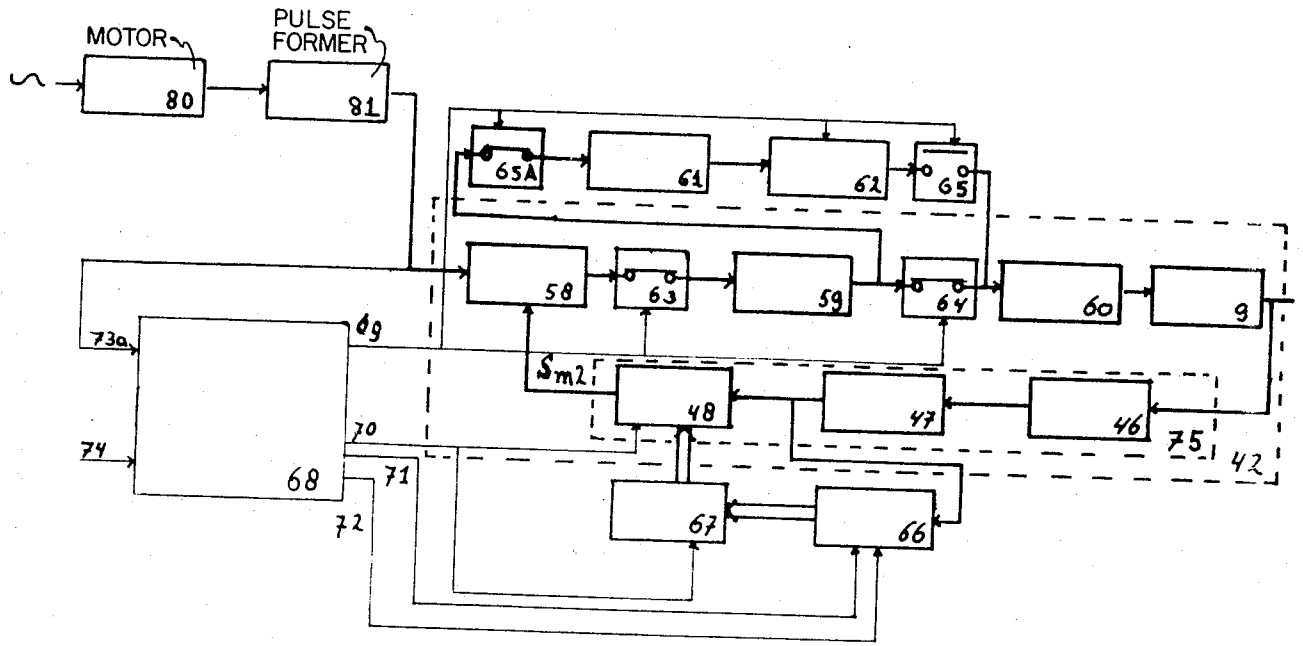
FIG. 5 a schematic representation of an alternative embodiment of a control system of a transfer apparatus according to the invention.

FIG. 5 schematically represents an alternative embodiment of a control system for a transfer apparatus according to the invention. In this embodiment, belt 16 is driven by an asynchronous motor 80. Motor 80 is energized by an A.C. voltage originating from the mains. A reference source 81 containing a pulse disc generates by means of this pulse disc a reference signal 73*a* at a frequency proportional to the speed of belt 16. This reference signal is delivered to control circuit 68 and to phase detector 58. The control circuit 68 and phase detector 58 and the other elements denoted by reference numerals in FIG. 5 are identical to the elements denoted by corresponding reference numerals in FIG. 2.

It will be obvious that the transfer apparatus as illustrated in the drawings and described hereinbefore can be modified in various ways while still utilizing the basic principles of the invention. For example, the functions of the control circuit 68, register 67 and counter 66 can be provided in a microcomputer. Also, it is not necessary to effect the determination of the dividend for the adjustable divider 48 during each transfer of the powder image to belt 16. This determination can be effected, for example, once per hour, once per day, or at each periodic occasion for maintenance service on a copying machine equipped with the transfer apparatus; and the dividend then determined can be stored in a non-volatile memory. Further, the phase comparator, the measuring circuit and the reference source may also be replaced by devices of other types, e.g., respectively, by a voltage comparator, a tachogenerator with an amplifier, and a voltage reference source. In such a case, during the transfer of a powder image to belt 16 the measuring circuit for measuring the speed of the belt can be so adjusted that the voltage levels of the measuring signal and the reference signal delivered to the comparator are equal to one another for equal speeds of belts 1 and 16.

The fairly short belt 1 described can also be replaced by a longer belt meandering over rollers, by a zig-zag folded belt, or by a drum. The description of an application of the invention to an electrophotographic copying machine is also only an example. The invention can be applied equally well to machines based on some other process, e.g. electrography or magnetography and/or processes in which the images formed and transferred are not powder images but are, for example, liquid or charge images.

I claim:

1. In an apparatus for transferring image information, including a first medium and a separate second medium, each for carrying image information and from one of which image information can be transferred to the other, respective drive systems for advancing said media each at a constant or substantially constant speed, and means for pressing one of said media into frictional contact with the other and holding the media in such contact during a time interval suited for transfer of image information from one advancing medium to the other, and for separating the media after each said interval, so that during each said interval the first medium will be advanced at exactly the speed of the second medium under the frictional force of such contact, a speed control system comprising means for adapting one of said drive systems to the other of them during a said time interval when said media are being advanced at the same speed by frictional contact with one another so that the respective drive systems will keep the speeds of said media substantially equal when the media are being advanced separate from one another.

2. In an apparatus for transferring image information, including a first medium and a separate second medium, each for carrying image information and from one of which image information can be transferred to the other, respective drive systems for advancing said media each at a constant or substantially constant speed, and means for pressing one of said media into frictional contact with the other and holding the media in such contact during a time interval suited for transfer of image information from one advancing medium to the other, and for separating the media after each said interval, so that during each said interval said first medium will be advanced at exactly the speed of said second medium under the frictional force of such contact, means for generating a reference signal at a value representing a required speed of said media, said drive system of said first medium including:

measuring circuit means for generating a measuring signal at a value which is a measure of the speed of said first medium, speed control means operative while said media are being advanced separate from one another for controlling the speed of said first medium to a value governed by relative values of said reference and measuring signals, means rendering said speed control means inactive during each interval of said media being advanced in frictional contact with one another, and adjusting means operable within a time interval of said media being advanced at the same speed by frictional contact with one another to produce an adjusting signal whereby, when said media are advanced separate from one another, the relation of said measuring signal to said reference signal is adjusted so as to keep the measuring and reference signals substantially equal to one another.

3. In an apparatus for transferring image information, including a first medium and a separate second medium, each for carrying image information and from one of which image information can be transferred to the other, respective drive systems for advancing said media each at a constant or substantially constant speed, and means for pressing one of said media into frictional contact with the other and holding the media in such contact during a time interval suited for transfer of image information from one advancing medium to the other, and for separating the media after each said interval, so that during each said interval said first medium will be advanced at exactly the speed of said second medium under the frictional force of such contact, means for generating a reference signal at a value representing a required speed of said media, said drive system of said first medium including:

measuring circuit means for generating a measuring signal at a value which is a measure of the speed of said first medium, speed control means operative while said media are being advanced separate from one another for controlling the speed of said first medium to a value governed by relative values of said reference and measuring signals, means rendering said speed control means inactive during each interval of said media being advanced in frictional contact with one another, means operable within a said time interval of said media being advanced in frictional contact with one another to produce and retain an adjusting signal representing the relation of the speed of said media to said reference signal, and means operable thereafter when said media are being advanced separate from one another to produce an adjusted measuring signal representing the relation of said measuring signal to said adjusting signal so that the controlled speed of said first medium when it is being advanced separate from said second medium will be substantially the same as its speed when it is being advanced in contact with said second medium.

4. An apparatus according to claim 3, said speed control means including means for generating in accordance with relative values of said reference and measuring signals a control signal to govern the speed of said first medium, means for storing said control signal at its value which exists just before each inactivation of said speed control means, and means for applying the stored control signal value to govern the speed of said medium upon separation of said media after each said interval of the media being advanced in frictional contact with one another.

5. An apparatus according to claim 4, said speed control means further including comparator means for producing in accordance with relative values of said reference and measuring signals an output to activate said control signal generating means, said measuring circuit means being operative during each interval of said media being advanced in frictional contact with one another to apply to said comparator means a signal at least approximately equal in value to said reference signal.

6. An apparatus according to claim 3, 4, or 5, said drive system of said second medium including means for generating a second measuring signal at a value which is a measure of the speed of said second medium and a second, continuously operative speed control means responsive to respective values of said reference signal and said second measuring signal for keeping said second medium at a speed corresponding in measured value to said reference signal.

7. An apparatus according to claim 3, 4, or 5, said drive system of said second medium including a motor for continuously driving said second medium, said reference signal generating means comprising means driven by said motor for generating pulses at a frequency corresponding to the speed of said second medium.

8. An apparatus according to claim 3, 4, or 5, said reference signal generating means comprising means to generate reference pulses at a frequency corresponding to said required speed;

said measuring circuit means including means for generating speed pulses at a frequency corresponding to the speed of said first medium, means for multiplying the frequency of said speed pulses and a frequency divider to receive the speed pulses of multiplied frequency;

said means to produce and retain an adjusting signal including counter means operable during at least one of the periods between said reference pulses to produce a count of the speed pulses of multiplied frequency, and register means to store said count;

said means to produce an adjusted measuring signal including means rendered operative when said media are separated from one another to apply signal information corresponding to said count from said register means to said frequency divider for division by said divider into the speed pulses of multiplied frequency;

said speed control means including means for detecting and comparing respective phases of said reference pulses and an adjusted measuring signal output of said frequency divider.

* * * * *